United States Patent [19]

Gram

[11] Patent Number: 4,482,341

[45] Date of Patent: Nov. 13, 1984

[54] MECHANISM FOR CONVERTING A CROSS-SECTIONALLY SUBSTANTIALLY U-SHAPED WEB OF WRAPPING MATERIAL INTO A WRAPPING TUBE

[75] Inventor: Hans Gram, Vojens, Denmark

[73] Assignee: Brødrene Gram A/S, Vojens, Denmark

[21] Appl. No.: 356,916

[22] Filed: Mar. 10, 1982

[30] Foreign Application Priority Data

Mar. 18, 1981 [DK] Denmark ..... 1233/81

[51] Int. Cl.[3] ..... B65B 9/08

[52] U.S. Cl. ..... 493/302; 53/550; 226/95; 226/162; 493/197

[58] Field of Search ..... 53/550, 551, 552, 568; 226/158, 162, 95; 493/302, 295, 193–197

[56] References Cited

U.S. PATENT DOCUMENTS

| | | | |
|---|---|---|---|
| 2,285,263 | 6/1942 | Fitch | 493/302 X |
| 2,555,758 | 6/1951 | Noble et al. | 493/302 X |
| 2,701,989 | 2/1955 | Hayward et al. | 493/302 |
| 3,748,822 | 7/1973 | Borgardt | 53/550 |
| 3,963,161 | 6/1976 | Jerney et al. | 226/162 X |
| 4,299,075 | 11/1981 | Gram | 53/550 |

*Primary Examiner*—James F. Coan

*Attorney, Agent, or Firm*—Watson, Cole, Grindle & Watson

[57] ABSTRACT

For converting a web of wrapping material from a U-shaped cross section into a tubular shape, an edge guiding mechanism is used having two edge engaging means which may be performed as suction means. Each of the suction means is supported by a pair of guiding rods converging from a forming means and towards a longitudinal welding means. When the suction means are moved along the rods, the suction means are moved towards one another. The suction means provide an engagement with the outer surface of the edges of the web of material and ensure the movement of the edges towards one another and towards the longitudinal welding means so that a web even of a thin and flexible material is securely engaged with the longitudinal welding means.

6 Claims, 3 Drawing Figures

MECHANISM FOR CONVERTING A CROSS-SECTIONALLY SUBSTANTIALLY U-SHAPED WEB OF WRAPPING MATERIAL INTO A WRAPPING TUBE

BACKGROUND OF THE INVENTION

The present invention relates to a mechanism for converting a cross-sectionally substantially U-shaped web of wrapping material into a wrapping tube by welding together the longitudinal edges of the web by moving the latter against one another and through a welding device.

In the commonly owned U.S. Pat. No. 4,299,075, dated Nov. 10, 1981, a wrapping apparatus is described having forming means imparting to webs of wrapping material of U-shaped cross section as these pass through the forming means. From the forming means the webs of wrapping material are moved through longitudinal welding means for welding together the longitudinal edges of the webs. The wrapping apparatus works with webs of wrapping material coated with a weldable material. Such a wrapping material is sufficiently rigid to be self-supporting between the forming means and the longitudinal welding means, with the effect that the guidance of the longitudinal edges provided by the longitudinal welding means is sufficient to move these against one another after the edges leave the forming means.

In experiments underlying the present invention it has been attempted to use another and far more flexible and "live" wrapping material, i.e. in the form of strips of thin plastic film. It was found, however, that owing to lack of rigidity this material is not sufficiently self-supporting to pass in a freely suspended state from the cross-sectionally substantially U-shaped form to a tubular shape, i.e. with the longitudinal edges abutting one another.

SUMMARY OF THE INVENTION

It is the object of the present invention to provide a mechanism as indicated by way of introduction by means of which it is possible in a simple manner to guide the edges of the web of wrapping material in such a way that these, without the risk of the web of material crumpling, may be moved positively from the position assumed by them when the web of material is of U-shaped cross section to the position assumed by them when the web of material is of tubular shape, and according to the invention, this is achieved by an edge guiding mechanism arranged ahead of the welding device and comprising means for engagement with the longitudinal edges of the web of wrapping material, guiding means for the engaging means arranged in convergent relationship as viewed in the travelling direction of the web and means for moving the engaging means along the guiding means. Thereby it is achieved that the engaging means are able to grip the edges of the web of wrapping material while the latter has its U-shaped cross section, after which the engaging means by virtue of their guiding means will move such edges towards one another, i.e. to the position they are required to assume for welding together. This makes it possible to provide flawless longitudinal seam welding of webs of material of even extremely thin and flexible film material.

According to the invention, the engaging means are preferably constituted by suction means arranged to engage the outer surfaces of the longitudinal edges.

Engaging means in the form of such suction means for engagement with the outer surfaces of the longitudinal edges of the U-shaped web of material are advantageous in that they are capable of moving the inner sides of such longitudinal edges closely together. This does not, however, prevent that each engaging means may be formed as a pair of clamping lips or clamping fingers for engagement with the subject edge.

To ensure positive guidance of the suction means, the guiding means may according to one embodiment of the invention comprise two pairs of guiding rods, the rods of each pair being parallel, and where a suction means is movably mounted on each pair of rods by means of holes passing through such suction means. This ensures non-tilting guidance of the suction means.

Another advantageous embodiment of the mechanism according to the invention is characterised in that, viewed in the travelling direction of the web of wrapping material, the guiding means are arranged in convergent relationship to the bottom of the generally U-shaped web of material. This makes allowance for the fact that the edges of the web of material when this is converted from a U-shaped cross section to a tubular shape will have less spacing from the bottom of the web of material so as to prevent slipping of the engaging means in relation to the wrapping web and a lifting of the latter respectively.

According to the invention, the actuating means for the engaging means are preferably constituted by a rod provided with a slot and arranged transversely of the web of material, the engaging means engaging the slot. Such a rod is capable of moving the suction means along the guiding means, allowing at the same time movement of the suction means against one another.

Such actuating means are especially advantageous when a mechanism for converting a plurality of webs from a U-shaped cross section into a tubular shape is concerned, as in this case it is possible to use one rod comprising the entire transverse extension of the mechanism, the rod being provided with a slot for each pair of engaging means. In a wrapping apparatus as described by way of introduction such a rod is readily connected up with welding means which provide transverse welding of the wrapping tubes formed, and to which rod is imparted a reciprocating movement for moving the webs of material through the wrapping apparatus.

DESCRIPTION OF THE PREFERRED EMBODIMENT

Figure 1:
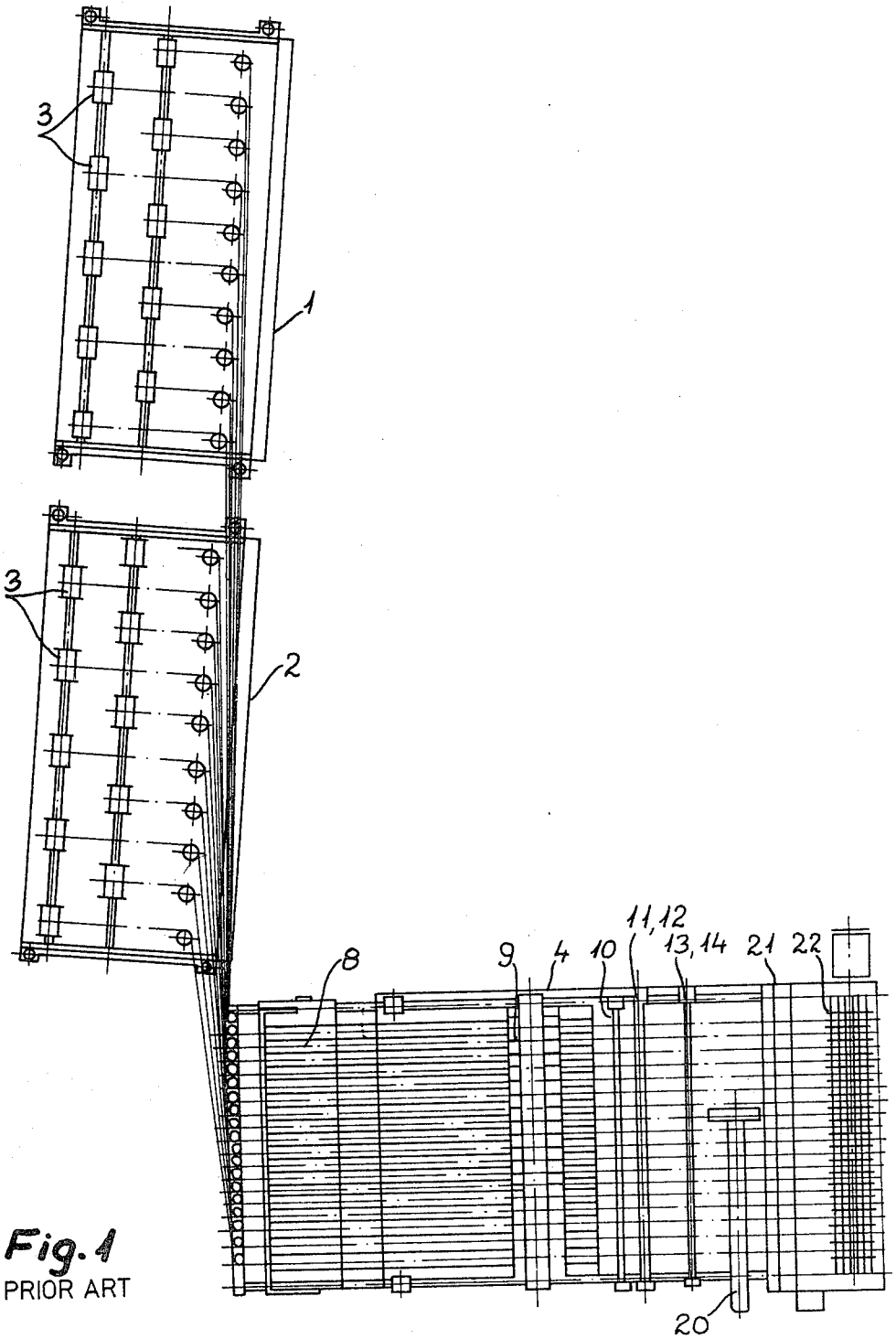
Fig. 1 PRIOR ART
FIG. 1 is a plan view of a prior art wrapping apparatus having a plurality of wrapping lines as described by way of introduction, and for which the mechanism according to the present invention is suitable.
Figure 2:
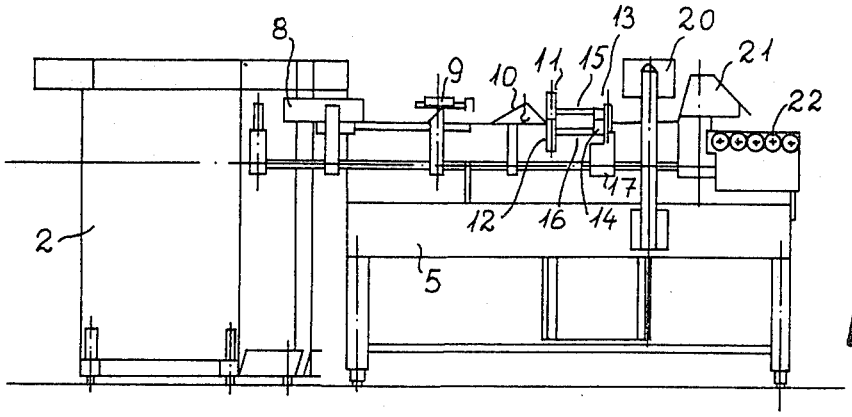
Fig. 2 PRIOR ART
FIG. 2 is a front view of the wrapping apparatus shown in FIG. 1, i.e. from below in FIG. 1.

The wrapping apparatus illustrated in FIGS. 1 and 2 comprises two spool frames 1 and 2, each supporting a plurality of rolls 3 of wrapping material such as paper coated on one or both sides with a weldable material. The wrapping apparatus itself is designated 4 in FIG. 1 and comprises, as will appear from FIG. 2, a frame 5 which viewed from left to right supports a row of forming means 8 arranged transversely of the travelling direction of the machine and imparting to the webs of wrapping material a U-shaped cross section during their passage through the forming means. The apparatus is provided with a depositing device, not shown, for depositing objects in the U-shaped webs. Following the forming means 8, the frame 5 supports a pair of longitudinal welding means 9 by means of which the longitudinal edges of each web are welded together, and this is followed by a pair of folding means 10 for flattening the longitudinal seam provided. The latter means are followed by a pair of heating means 11, 12 and a pair of clamping means 13, 14 which in combination constitute tools for providing transverse welds. The pair of heating means comprises a transverse top rail 11 and a transverse lower rail 12, and the pair of clamping means comprises a top rail 13 and a lower rail 14. The two top rails 11 and 13 are interconnected by means of arms 15, and the two lower rails 12 and 14 are interconnected by means of arms 16. The top rail 13 and the lower rail 14 are connected to an engaging and disengaging mechanism 17 by means of which the two top rails 11, 13 are movable upwardly and the two lower rails 12, 14 are at the same time movable downwardly. The spacing between the heating means and the clamping means is equal to the length of the wrapped products to be obtained. The welding station constituted by such means is reciprocating in the travelling direction of the machine having a stroke equal to the length of the packages to be produced.

The transverse welding station is followed by a control panel 20 and then a cutting and holdling station 21 together with a roller conveyor 22 for separated packages.

The wrapping apparatus illustrated in FIGS. 1 and 2 operates as follows:

Prior to starting, the webs of material are threaded through the forming means 8, passed with their edges through the welding means 9 of the longitudinal welding station, through the seam flattening means 10, in between the top and lower rails 11, 13 and 12, 14 respectively moved away from each other and on to the station 21 and out through the cutting means of the latter. It will now be understood that by imparting a reciprocating stroke to the engaging and disengaging mechanism 17 and by closing the rails of the welding station prior to initiation of the forward stroke and opening of same at the completion of the stroke, the webs of materials will be passed stepwise through the apparatus, and objects deposited in the webs of material will be wrapped and separated from the webs of material at the station 21.

The apparatus illustrated in FIGS. 1 and 2 works excellently when the wrapping material used is paper which, as stated, is coated on one or both sides with a weldable material. The point is that such wrapping material is capable of supporting itself to the effect that the material is sufficiently rigid to pass from the U-shaped cross section, imparted by the forming means 8, to the shape assumed by the web with its edges abutting one another and being welded together by means of the longitudinal welding means 9.

Figure 3:
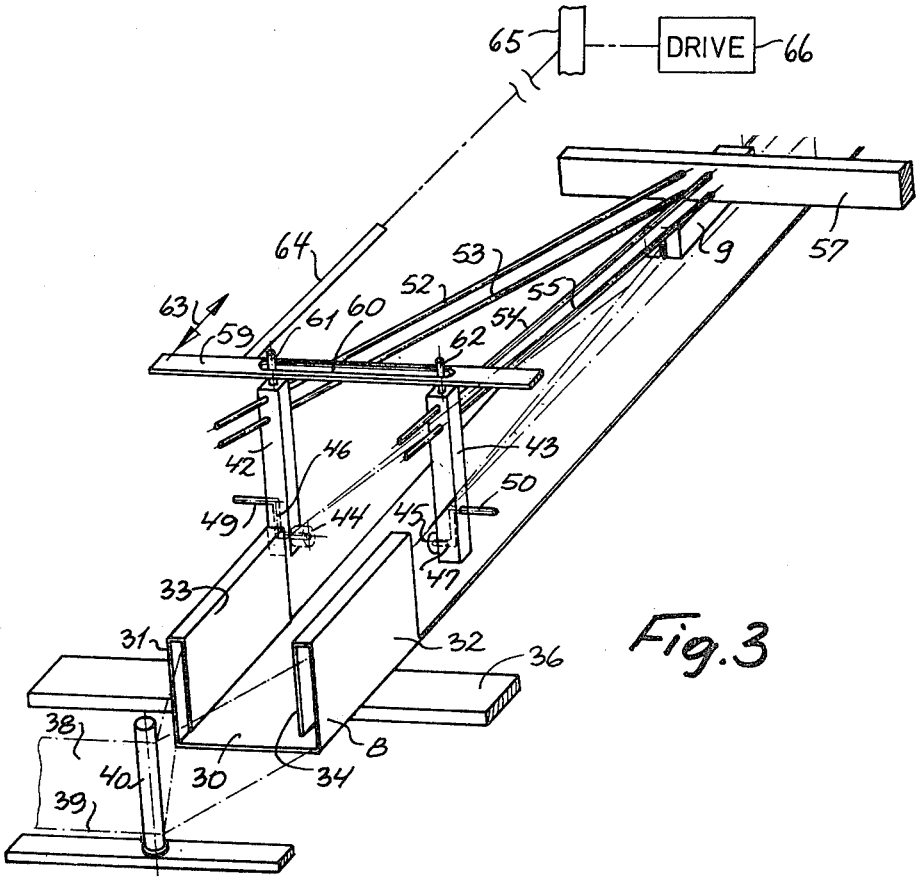
FIG. 3 is a view of an embodiment of the mechanism according to the present invention for use in combination with a wrapping apparatus as illustrated in FIGS. 1 and 2.

If an attempt is made to use the apparatus in connection with thinner webs of material such as relatively thin plastic film it has been found by experiments that difficulties are encountered when feeding the edges of the webs of material into the longitudinal welding means 9. To overcome this a mechanism such as illustrated in FIG. 3 is used. For the sake of clarity FIG. 3 shows a mechanism for a single web only, but it will be readily understood from the above explanation that the mechanism may be multiplied to conform to the number of webs of material.

The mechanism illustrated in FIG. 3 is designed to be arranged between the forming means 8 and the longitudinal welding means 9 for the apparatus according to FIG. 1 or 2 or similar apparatus in which a web of wrapping material is to be converted from a U-shaped cross section to a tubular shape. In FIG. 3 numeral 8 designates a forming means bent from sheet metal so as to have a U-shaped cross section with a bottom 30 and two vertical outer side walls 31 and 32 supporting inwardly and downwardly bent inner side walls 33 and 34 to the effect that the pairs of walls 31, 33 and 32, 34 form downwardly open, narrow channels.

The forming means 8 is secured to the top side of a transverse rod 36 which, when the mechanism is to be used, is connected to the frame 5 of the apparatus to the effect that the rod 36 extends transversely of the travelling direction of the machine. When used in connection with a multiline wrapping apparatus there are arranged a plurality of forming means on the transverse rod 36 corresponding to the number of webs.

FIG. 3 shows additionally a pair of longitudinal welding means 9 comprising, in a manner known per se, two longitudinal rails that can be heated and are movable to a small extent away from and towards one another to provide intermittently a longitudinal weld seam of the edges of a web of material designated 38 in FIG. 3. The latter comprises a relative thin, flexible plastic film and arrives at the feed end of the folding means 8 folded along a lower folding line 39, and guided by a guide pin 40. After the pin 40, the sides of the web of material are separated from each other by being passed through respective side wall channels in the forming means 8 with the effect that the web of material assumes a substantially U-shaped cross section.

To ensure positive guidance of the top edges of the web of material, as these are moved from the discharge end of the forming means 8 to the longitudinal welding means 9, the mechanism of FIG. 3 is provided with two engaging means 42, 43 which in the embodiment illustrated comprise suction means, each supporting, at their lower end, suction disks 44 and 45, respectively, which through respective channels 46 and 47 in such suction means are in communication with a suction hose 49 and 50, respectively. The suction means 42 and 43 are mounted on guiding means comprising two pairs of guiding rods 52, 53 and 54, 55, respectively. The guiding rods of each pair extend in parallel relationship and in one and the same vertical plane. The upper end of each suction means 42 and 43 is provided with two holes by means of which each suction means 42, 43 is allowed to slide on respective pairs of rods 52, 53 and 54, 55. The forward ends in FIG. 3 of the rods 52–55 are supported by a transverse rod, not shown, and the rods 52–55 are spaced from one another so that, in the position of the suction means 42 and 43 shown in FIG. 3, the suction disks 44, 45 are positioned substantially opposite the ends of the side channels of the forming means 8. The rearward ends in FIG. 3 of the rods 52–55 are secured to a transverse rod 57. The two transverse rods supporting the guiding rods 52–55 are designated, in a manner not shown in detail, for connection to the frame 5 of the apparatus. From FIG. 3 it will be seen that the two pairs of rods 52, 53 and 54, 55 converge from the forming means 8 toward the longitudinal welding means 9, viz. to the effect that the suction means 42, 43, when moved on to a position adjacent the longitudinal welding means 9, will be close to one another.

For moving the suction means 42 and 43, the mechanism is provided with a rod 59 arranged transversely to the web of material and having a slot 60. Upwardly extending pins 61 and 62, respectively, engage with the slot, the pins being supported by respective suction means 42 and 43. It will thus be understood that when the rod 59 is subjected to a reciprocating movement, as indicated by the double arrow 63, the suction means 42 and 43 will perform the movement referred to above.

The rod 59 may be connected by a rod 64 to a suitable structure 65 of the welding station of the apparatus such structure in turn being connected to a drive means 66 for applying a reciprocating stroke movement, as indicated by double arrow 63, to the transverse welding tools 11 to 14, as well as to rod 59. Such drive means, connected to the welding station for reciprocating the welding tools thereof, is clearly disclosed in the aforementioned patent.

The mechanism illustrated in FIG. 3 operates as follows:

At the completion of the return stroke of the welding station, the suction means 42, 43 will assume the position shown in FIG. 3. In this position, the hoses 49, 50 will be subjected to a negative pressure to make the suction disks 44, 45 adhere to the oppositely located edges of the web of material 38. During the forward stroke of the welding station, the suction means 42, 43 will be carried along by virtue of the driving effect of the rod 59 on the pins 61 and 62, and the latter will at the same time move towards each other in the slot 60 as a result of the convergent position of the pairs of rods 52, 53 and 54, 55. This ensures positive transfer of the edges of the web of material 38 to the feed end of the welding means 9, at which point the suction effect present in the hoses 49 and 50 is interrupted to release the edges of the web of material with the result that the suction means 52, 53 may be retracted to the position shown in FIG. 3 during the following stroke of the apparatus.

In addition to converging towards each other, the pairs of rods 52, 53 and 54, 55 also converge slightly in relation to the bottom of the web of material or, in other words, during the movement towards the welding means 9, the suction disks 44, 45 will be moved slightly downwards. This makes it possible for the suction disks 44 and 45 to guide the edges of the web of material positively, seeing that it will be understood that their spacing from the bottom of the web of material will decrease slightly during the conversion of the U-shaped cross section of the web of material to its tubular shape.

The mechanism shown in FIG. 3 has been explained above in connection with a special wrapping apparatus as illustrated in FIGS. 1 and 2 and comprising a pair of clamping means 13, 14, a pair of heating means 11, 12 together with a cuttng and holding station 21, but it will be readily understood that the mechanism shown in FIG. 3 may without difficulty be used in combination with more simple wrapping apparatus of the type in which the transverse welding of the wrapped products is provided by means of a single pair of engaging and disengaging reciprocating welding means which may also be provided with cutter means for separating the finished wrapped products.

I claim:

1. A mechanism for converting a cross-sectionally substantially U-shaped web of wrapping material into a wrapping tube by welding together the longitudinal edges of the web by moving the latter against one another and through a welding device, characterized by an edge guiding mechanism arranged ahead of the welding device and comprising means for engagement with the longitudinal edges of the web of wrapping material, guiding means for the engaging means arranged in convergent relationship as viewed in the travelling direction of the web and means for moving the engaging means along the guiding means.

2. A mechanism as claimed in claim 1, characterized in that the engaging means are constituted by suction means designed to engage the outer surfaces of the longitudinal edges of the web.

3. A mechanism as claimed in claim 2, characterized in that the guiding means comprise two pairs of guiding rods, the rods of each pair being parallel, and the suction means being movably mounted on each pair of rods by means of holes passing through the subject suctions means.

4. A mechanism as claimed in claim 1, characterized in that, viewed in the travelling direction of the web of wrapping material, the guiding means are arranged in convergent relationship to the bottom of the generally U-shaped web of material.

5. A mechanism as claimed in claim 1, characterized in that the moving means include a rod provided with a slot and arranged transversely of the web of material, the engaging means engaging said slot.

6. A mechanism as claimed in claim 2, characterized in that the lower end of each suction means supports a suction disk or suction opening, each of the disks or openings being connected to a vacuum source by means of a hose.

* * * * *